United States Patent [19]

Brown

[11] 3,947,027

[45] Mar. 30, 1976

[54] HIGH PERFORMANCE GOLF TEE

[76] Inventor: David F. Brown, 236 Palmer, NE., Grand Rapids, Mich. 49505

[22] Filed: May 13, 1974

[21] Appl. No.: 469,084

[52] U.S. Cl. ..... 273/33; 273/212

[51] Int. Cl.[2] ..... A63B 57/00

[58] Field of Search ..... 273/33, 202–212; D34/5 GT

[56] References Cited

UNITED STATES PATENTS

| | | | |
|---|---|---|---|
| 1,535,181 | 4/1925 | Sawyer | 273/33 |
| 1,670,123 | 5/1928 | Ranseen | 273/209 X |
| 3,347,551 | 10/1967 | Dreyfus | 273/33 X |
| 3,414,268 | 12/1968 | Chase | 273/211 |
| 3,473,812 | 10/1969 | Pelzmann | 273/211 X |
| 3,506,263 | 4/1970 | Arrington | 273/33 |
| 3,675,929 | 7/1972 | Guarino, Sr. et al. | 273/211 X |
| D181,338 | 11/1957 | Beckwith | D34/5 GT |
| D232,568 | 8/1974 | Brown | D34/5 GT |

*Primary Examiner*—Richard J. Apley
*Assistant Examiner*—Harry G. Strappello
*Attorney, Agent, or Firm*—McGarry & Waters

[57] ABSTRACT

A high performance golf tee comprises a stem, a cup-shaped ball receptacle on the top of the stem, and a projection extending outwardly from the ball receptacle a sufficient distance such that when a golf ball is placed on the tee and a golf club is swung at the ball, the golf club contacts the projection and imparts motion to the ball before the golf club makes direct contact with the surface of the golf ball. The contact between the golf club and the projection imparts an initial backspin on the ball, and this improves the flight characteristics of the ball. The golf tee may be integrally molded as a unit including the projection or the projection may be formed as an attachment for a conventional golf tee.

16 Claims, 11 Drawing Figures

HIGH PERFORMANCE GOLF TEE

BACKGROUND OF THE INVENTION

Field of the Invention

This invention relates to golf tees and more particularly to a high performance golf tee adpated to improve the distance and flight characteristics of golf balls driven from the tee.

Background of the Invention

It is well known that the flight of a golf ball is dependent to a certain extent upon backspin imparted to the ball by contact between the golf club and the surface of the ball. As a golf ball travels through the air, the dimpled surface of the golf ball is effective to increase the drag on the air surrounding it. This drag results in a differential in air pressure when the ball is spinning, and this differential alters the flight pattern of the ball. When a ball is given a backspin, the nose of the ball spins in an upward direction. The dimples of the golf ball thus are rotating in the same direction as the flow of air past the golf ball on the top of the golf ball and the dimples are moving counter to the flow of air on the bottom of the golf ball. The drag of the dimpled surface of the golf ball on the air flowing past the ball increases the air pressure below the golf ball and decreases the air pressure above the golf ball. The differential in air pressure results in an upward force on the ball, and this upward force sustains the flight of the golf ball for a longer distance than would otherwise result if no spin at all were imparted to the ball. In a similar manner, a hook or slice (i.e., a curve to the left or right, respectively) is imparted to the ball by imparting a spin to the golf ball with the golf club in much the same manner as a curve ball is thrown in baseball.

Another effect on golf ball flight that is well recognized is that the flight characteristics of a golf ball are unpredictable and unreliable when no backspin is placed on the ball. This phenomenon is analogous to the random flight path of a knuckle ball in baseball, wherein no initial spin is placed on the ball. When a backspin is placed on a golf ball, the golf ball follows a straigter path and carries further than a ball without backspin. All golf clubs, except perhaps putters, impart some backspin on a golf ball, with the most backspin being produced with the more lofted clubs such as the irons, whereas the least amount of backspin is imparted to the ball with the least lofted club, which is the driver and the club typically used for striking a golf ball off a tee. The loft of a driver usually is in the range of 8°–10°.

In order to strike a ball with a driver and have the ball leave the ground and enter normal flight pattern, it is customary to place the ball on an elevated tee above the ground. One of the first tees employed in golf was a simple mound of earth on which the golf ball was placed. However, over the years, a number of different types of artificial golf tees have been developed in order to raise the golf ball off the ground on a pedestal. The only golf tee universally accepted has been a simple golf tee comprising a stem that is insertable into the ground with a cup-shaped golf ball receptacle mounted on the top of the stem for holding the golf ball in an elevated position. Other types of golf tees have been developed subsequent to that time, but none have been effective in improving the flight characteristics of the golf ball.

Some golf tees have been developed which provide a shield between the golf ball and the club so that the club strikes only the shield but not the golf ball. This shield is employed generally for the purpose of preventing cuts in the golf ball. Another purpose for such a shield is to alter the flight characteristics of the golf ball by placing the shield at skewed angles with respect to the back of the golf ball.

SUMMARY OF THE INVENTION

In accordance with the present invention, an improvement in the distance and flight characteristics of the golf ball is achieved with the high performance golf tee in the present invention. The golf tee of the present invention comprises a ball support mechanism for supporting the ball at a point above the ground, and an extension device extending outwardly from the ball support means a sufficient distance such that when a ball is placed on the ball support and a club is swung at the ball, the club strikes the extension before it strikes the surface of the ball, thus imparting an initial motion to the ball before the club strikes the surface of the ball. This initial motion breaks the static coefficient of friction between the ball and the tee and places the ball in a dynamic state at the time that the club makes contact with the ball.

Another important aspect of the present invention is that the initial motion imparted to the ball is in the nature of a backspin. Thus, the ball is not only placed in a dynamic state but it is provided with an initial backspin when the club face makes contact with the ball. This initial backspin improves both the distance and the flight stability of the ball.

The golf tee of the present invention may be formed in one of several embodiments. In one embodiment, the golf tee comprises a stem with a cup-shaped receptacle on the top of the stem and a projection in the form of a tab extending outwardly from the top of the golf tee. The projection is positioned rearwardly with regard to the direction of flight of the golf ball, such that the club head strikes the projection before it strikes the golf ball.

In another embodiment of the present invention, the golf tee comprises a stem, and a generally flat upper surface having an oblong configuration mounted on the top of the stem. Separate golf ball receptacles are provided in each end of the oblong upper surface, such that the golf ball may be placed on either end of the upper surface, with the other end of the upper surface serving as the extension for engaging the golf club before the golf club engages the ball. This stem may be attached either to the middle of the upper surface or it may be attached along an edge of the upper surface. When attached along the edge of the upper surface in cantilever fashion the tee pivots in the ground when the club makes contact with the upper surface.

In still another embodiment of the present invention, the golf tee comprises a stem having a cup-shaped receptacle mounted on the top thereof, with the extension comprising a disc member extending radially in all directions from the top of the tee. Thus, the tee can be faced in any direction when inserted in the ground and the club head will always make contact with the edge of the tee before it makes contact with the ball.

In still another embodiment of the present invention, the extension is not integrally formed with the rest of the tee but is in the form of an attachment that may be fitted on a conventional wooden or plastic tee. The attachment comprises a base having a tab extending outwardly therefrom, with the base including an opening therein that accommodates the head or cup-shaped receptacle of a conventional tee. The conventional tee is fitted into this opening and is locked in the opening by a snap fit on the top.

In order to achieve a proper amount of initial ball movement, the extension should extend outwardly a distance of about ⅝ to 1½ inches from the center of the golf ball receptacle. Preferably, the distance should be ¾ to 1¼ inches, and ideally the distance should be ⅞ 1 inch.

These and other advantages and features of the present invention will hereinafter appear and for purposes of illustration, but not of limitation, a preferred embodiment of the present invention is shown in the attached drawings and described in detail below.

IN THE DRAWINGS

DETAILED DESCRIPTION OF PREFERRED EMBODIMENTS

Figure 1:
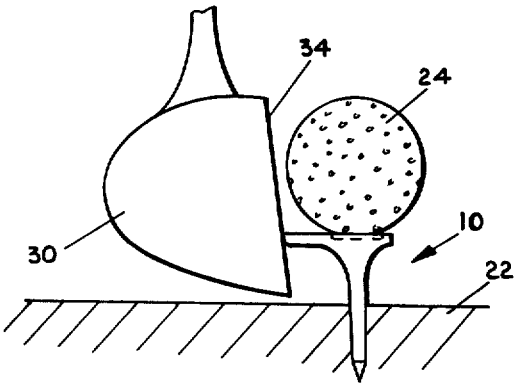
FIG. 1 is a pictorial side view showing a golf ball mounted on a first embodiment of the golf tee of the present invention, with the club head in position to make contact with the golf tee.

Referring now to the drawings, and more particularly to FIGS. 1–4, a first embodiment 10 of the golf tee of the present invention comprises a ball supporting mechanism 12 for maintaining a golf ball in a fixed position above the ground and a golf tee extension 14 extending outwardly from the ball supporting mechanism. Ball support 12 comprises a stem 16 and a cup-shaped golf ball receptacle 18 mounted on the upper end thereof. Stem 16 has a pointed lower end 20 that is adapted to be inserted into the ground 22 in a generally vertical direction (as shown in FIG. 1). Cup-shaped receptacle 18 is shaped so that a golf ball 24 will rest in the receptacle when the tee is inserted vertically in the ground. The cup-shaped receptacle 18 includes a center 26, which is a point lying directly below the center of golf ball 24 when it is resting in the receptacle. When the cup-shaped receptacle is completely circular, center 26 comprises the center of the circle.

Figure 4:
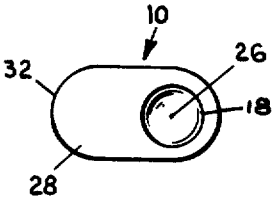
FIG. 4 is a top plan view of the first embodiment of the golf tee of the present invention.

Extension 14 in the first embodiment of the present invention is a laterally extending projection or tab 28 that extends outwardly from the top of the cup-shaped receptacle 18. The upper surface of the golf tee has an oval configuration, as shown in FIG. 4.

Figure 2:
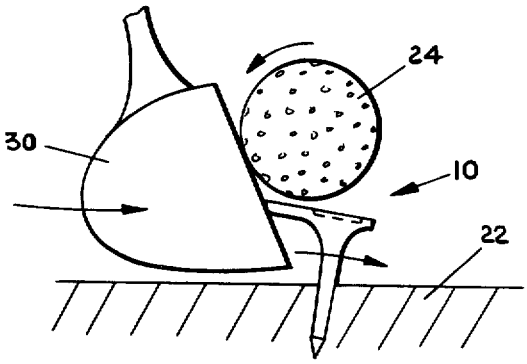
FIG. 2 is the same view as FIG. 1, shown momentarily later, after the golf ball has been placed in motion by the contact between the golf club and the tee.
Figure 3:
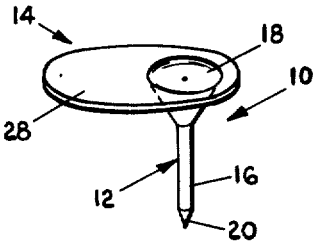
FIG. 3 is a pictorial view of the first embodiment of the golf tee of the present invention.

Projection 28 extends outwardly from a line extending vertically through center 26 of the golf ball receptacle a distance sufficient to insure that a golf club 30 (as shown in FIG. 1) swung at golf ball 24 will strike the outer edge 32 of projection 28 momentarily before the golf club strikes the golf ball itself. As shown in FIG. 2, the impact between the golf club and projection 28 causes the golf ball to rock backwardly on the tee and become in a dynamic state before the golf club makes contact with the golf ball. The dynamic state of the golf ball and the initial backspin imparted to the golf ball by the action of the golf tee against the golf ball improve both the distance of the golf ball and the flight characteristics of the golf ball over the distance and flight characteristics obtainable with a conventional golf tee.

In order to achieve the foregoing advantage of imparting an initial motion to the ball in the form of a backspin momentarily before the club strikes the surface of the ball, it is important that the dimensions of the projection be within certain limitations. It is not necessary that the projection actually extend outwardly beyond the periphery of the ball, because a driver will typically have a club face 34 that is designed to be inclined at an angle of about 8°–10° with respect to a vertical line at the point where the club face makes contact with the ball. Thus, the lower portion of the club face will extend slightly under the outer perimeter of the ball when the club face makes contact with the ball. The dimensions disclosed herein for the golf tee of the present invention assumes that a normal golf club will be used with the tee, but substantial variation in the loft of the club face is permissible with the dimensions disclosed below.

Another factor in determining the dimension of the tee of the present invention is the diameter of the golf ball employed with the tee. The standard diameter of an American golf ball is 1-11/16 inches whereas the diameter of an English ball is about 1⅝ inches. Either ball will work satisfactorily with the golf tee of the present invention.

Although it is possible that a wider range of values could be effectively employed in order to accomplish the purposes of the present invention, the distance between center 26 of the golf ball receptacle and the outer end 32 of projection 28 should at least be within a range of ⅝ to 1½ inches. Preferably, this range should be about ¾ to 1¼ inches. Ideally, the distance range is ⅞ to 1 inch. In the preferred embodiment of the present invention, the distance between center 26 and outer end 32 is ⅞ of an inch.

The problem with employing a projection that is much longer than is needed is that when the projection is struck by a golf club, it pivots downwardly in the manner shown in FIG. 2, and an extraordinarily long projection could interfere with the normal contact between the club face and the ball. Unlike some prior golf tees, no part of the golf tee of the present invention is intended to prevent contact directly between the club face and the golf ball. The disadvantage with a projection that is too short is obvious. The projection will not be struck by a golf club before the golf club strikes the ball, thereby obiviating the advantages achieved with the golf tee of the present invention.

The golf tee of the present invention desirably is molded as an integral unit and can be formed of any suitable material, preferably a moldable plastic material. In the preferred embodiment of the present invention, the golf tee is formed of polypropylene, which provides a tough, durable product. Polyethylene also would be suitable.

Figure 5:
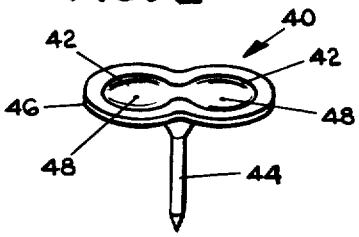
FIG. 5 is a pictorial view of a second emvodiment of the golf tee of the present invention.
Figure 6:
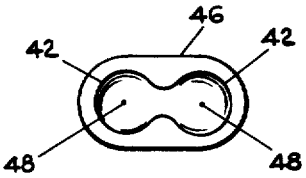
FIG. 6 is a top plan view of the second embodiment of the golf tee of the present invention.

A second embodiment 40 of the present invention is shown in FIGS. 5 and 6. This embodiment is similar to the embodiment shown in FIGS. 1–4 except that a pair of cup-shaped receptacles 42 are provided at the upper end of the tee. Receptacles 42 are formed in a generally flat upper surface 46 mounted on the upper end of a stem 44. The receptacles are joined along a common edge so that the recessed portion of upper surface 46 is shaped generally in a FIG. 8 configuration. Ball receptacles 42 have centers 48 which are defined in the same manner as center 26 of the first embodiment. Stem 44 is attached to the underside of upper surface 46 at the midpoint thereof, which is at the midpoint of a line extending between centers 48 of ball receptacles 42.

The principal advantage of the second embodiment of the present invention is that a golf ball may be placed on either of the two golf ball receptacles, and the other side of the upper surface will serve as the projection for engaging the golf club before the club engages the ball. Thus, a golf ball may be placed on the right golf ball receptacle (FIG. 5 orientation) until the left hand side of the upper surface is worn out or disfigured from repeated contact with the golf club. At that point, the ball may be placed in a left hand receptacle, and the right hand edge of the upper surface can be used as the extension or projection for contacting the surface of the golf club. By having two separate golf ball receptacles, mounted side by side, with the outer edge of one serving as the extension for the other and vice versa, the life of the tee as affected by contact between the golf club should be doubled.

Figure 8:
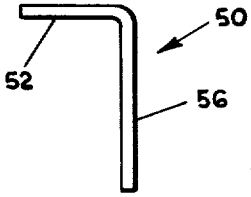
FIG. 8 is a rear elevational view of a fourth embodiment of the golf tee of the present invention.
Figure 9:
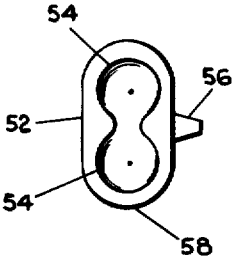
FIG. 9 is a top plan view of the fourth embodiment of the golf tee of the present invention.

Another version of the second embodiment of the present invention is shown in a fourth embodiment 50 of the present invention depicted in FIGS. 8 and 9. In that embodiment, an upper surface 52 generally conforming with the upper surface 46 of the second embodiment is provided with a pair of spaced golf ball receptacles 54. The principal difference between the second and fourth embodiments is that a stem 56 employed in connection with the fourth embodiment is attached in cantilever fashion to the side of upper surface 52 at the mid-point between the golf ball receptacles, instead of being attached at the center of the upper surface, as in the second embodiment. By attaching stem 56 to the side of upper surface 52, when a golf club makes contact with a tee at end 58, with the golf ball placed in the upper golf ball receptacle (according to FIG. 9 orientation) a torque will be exerted about stem 56, thus causing stem 56 to rotate in the ground instead of simply being pulled out of the ground or twisting in the ground. This reduces any frictional losses incurred in dislodging a tee from the ground.

Figure 7:
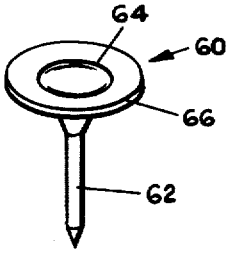
FIG. 7 is a pictorial view of a third embodiment of the golf tee of the present invention.

A third embodiment 60 of the present invention is shown in FIG. 7. In that embodiment, a stem 62 is provided with a cup-shaped receptacle 64 at the top thereof and a golf club engaging extension 66 in the form of a radially extending disc that extends outwardly from the outer edge of the cup-shaped receptacle. The radius of disc 66 conforms with the dimensions set forth above with regard to the distance between center 26 and end 32 of projection 28 in the first embodiment. Thus, the radius of disc 66 should be about ⅝ to 1½ inches, with a preferred range being ¾ to 1¼ inches, and the ideal range being ⅞ to 1 inch.

The principal advantage of the third embodiment shown in FIG. 7 is that the golf tee may be placed in the ground at any radial disposition about the axis of the stem. Since the disc member 66 extends outwardly the same distance in all directions, it is not necessary to align a projection so that it faces rearwardly with respect to the proposed direction of ball projection.

Figure 10:
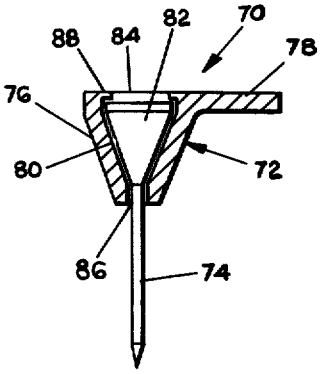
FIG. 10 is a sectional side elevational view of a fifth embodiment of the golf tee of the present invention.
Figure 11:
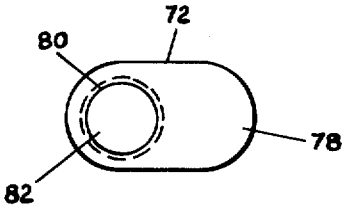
FIG. 11 is a top plan view of the fifth embodiment of the golf tee of the present invention.

A fifth embodiment 70 of the present invention is shown in FIGS. 10 and 11. In this embodiment, the golf tee extension comprises a removable attachment 72 for a conventional wooden or plastic golf tee 74 of conventional design. Attachment 72 comprises a base 76 and a laterally extending tab 78 that extends outwardly much in the manner of projection 28 in the first embodiment. Base 76 includes a vertically extending opening 80 therethrough with the inner surface of the opening conforming with the outer surface of ball receptacle 82 of the conventional tee. Opening 80 has an upper end 84 and a lower end 86, with the lower end being substantially smaller than upper end 84. The surface of the opening tapers inwardly from upper end 84 to lower end 86. The opening is shaped so that the conventional tee 74 can be fitted downwardly through opening 80 with the stem of the tee protruding downwardly through the lower end 86 of the opening. The upper end of the tee, however, will not pass entirely through the opening and engages the interior surface of opening 80 after the upper end is fitted within the opening. A locking device 88 in the form of an inwardly extending resilient projection at the upper end of the opening resiliently locks the conventional tee in place in the attachment after it has been fully inserted into the opening.

Aside from the fact that a conventional tee is employed instead of the integrally formed stem and ball receptacle of the previous embodiments, the critical dimensions and functions of attachment 72 is substantially the same as with all other embodiments.

In order to provide a suitable resting place for a golf ball on top of the tee and to provide frictional contact between the golf ball and the tee so that the movement of the tee upon impact between the golf club and the tee will impart a backspin motion to the golf ball, it is only necessary that the golf ball receptacle be recessed sufficiently so that the edge of the receptacle provides a gripping and resting surface for the golf ball. In the preferred embodiments of the present invention, the golf ball receptacle is circular and is approximately 9/16 inches in diameter and about 1/16 inches in depth.

It should be understood that various modifications and changes may be made in the arrangements and details of construction of the various embodiments of the present invention disclosed herein without departing from the spirit and scope of the present invention.

The embodiments of the invention in which an exclusive property or privilege is claimed are defined as follows:

1. A golf tee comprising ball supporting means adapted to support a golf ball at a point above the ground, and substantially rigid extension means extending substantially horizontally from the ball supporting means to an outer end positioned a sufficient distance from the ball supporting means such that when a golf club is swung at a golf ball resting on the golf tee with at least a portion of the extension means facing the golf club, the golf club strikes the outer end of the portion of the extension means before it strikes the ball, said extension means being adapted, on impact with the swinging golf club, to impart motion to the golf ball before the golf club strikes the ball, said extension means being further adapted to permit direct contact between the fact of the club and the surface of the golf ball after the extension means has been struck by the swinging golf club, the outer end of the extension means including a substantially horizontal, wide, non-pointed golf club contact surface that is capable of withstanding repeated engagement with a swinging golf club along said surface without marring the golf club or injuring or deforming the outer end of the extension means, the extension means also being sufficiently durable to withstand repeated engagement with a swinging golf club without injury to the extension means.

2. A golf tee as claimed in claim 1 wherein:

the ball supporting means comprises a stem and a cup-shaped golf ball receptacle mounted on the stem.

3. A golf tee as claimed in claim 2 wherein the projection extends radially outwardly from the ball supporting means a distance of at least about ⅝ and no more than about 1½ inches from a vertical line extending through the center of the ball receptacle, the center of the ball receptacle being the point on the ball receptacle that lies immediately below the center of a golf ball placed thereon.

4. A golf tee as claimed in claim 3 wherein the projection extends outwardly a distance of at least about ¾ and no more than about 1¼ inches from the line extending through the center of the golf ball receptacle.

5. A golf tee as claimed in claim 4 wherein the projection extends outwardly a distance of at least about ⅞ and no more than about 1 inch from the line extending through the center of the golf ball receptacle.

6. A golf tee as claimed in claim 2 wherein the golf ball receptacle is mounted on the top of the stem and the projection is a tab extending radially outwardly from the top of the ball receptacle.

7. A golf tee as claimed in claim 1 wherein:

the ball supporting means comprises an upper surface having first and second spaced golf ball receptacles therein, such that a golf ball can be supported on either receptacle; and the extension means comprise first and second portions of the upper surface, the first golf ball receptacle being formed in the first portion and the second golf ball receptacle being formed in the second portion, said second portion acting as the extension means when a golf ball is supported by the first golf ball receptacle and said first portion acting as the extension means when a golf ball is supported by the second golf ball receptacle.

8. A golf tee as claimed in claim 7 wherein:

each receptacle comprises a center with the center being the point in the receptacle that lies directly below the center of a golf ball placed on the receptacle; and said first and second portions extend outwardly a distance of at least about ¾ and no more than about 1¼ inches from the centers of the second and first receptacles, respectively.

9. A golf tee as claimed in claim 7 wherein the upper surface is substantially flat and is mounted on the upper end of a stem such that the plane of the upper surface is perpendicular to the axis of the stem, said upper surface being mounted on the stem about halfway between the centers of the ball receptacles on a line joining the centers.

10. A golf tee as claimed in claim 7 wherein:

the upper surface is substantially flat and is oblong in shape, with the golf ball receptacles being formed in each end of the upper surface; and the ball supporting means comprises a stem, an upper end of which is attached at right angles to a side edge of the upper surface at a point about halfway between the centers of the two ball receptacles, such that the upper surface is mounted in cantilever fashion from the stem, whereby the stem rotates in the ground when the upper surface is struck by a swinging golf club.

11. A golf tee as claimed in claim 1 wherein:

the ball supporting means comprises a stem having a cup-shaped golf ball receptacle mounted on the top end thereof; and the extension means comprises a circular disc member extending radially outwardly from the outer periphery of the golf ball receptacle.

12. A golf tee as claimed in claim 11 wherein the radius of the disc member is at least about ¾ and no more than about 1¼ inches.

13. A golf tee as claimed in claim 1 wherein:

the ball supporting means comprises a conventional golf tee having a stem with a cup-shaped golf ball receptacle on an upper end thereof; and the extension means is a separate member that is removably mounted on the conventional tee.

14. A golf tee as claimed in claim 13 wherein the extension means comprises:

a base having an opening therethrough, with the internal surface of the opening being shaped to conform with the ball receptacle on the stem, such that the stem can be fitted through the opening from an upper side thereof until the ball receptacle engages the interior of the opening, said opening being formed such that the ball receptacle cannot be passed entirely through the opening;

locking means on the base and adapted to resiliently hold the tee in the opening in the base after the ball receptacle has been fitted into said opening; and projection means extending outwardly from the base a sufficient distance such that when the tee is placed in the ground, with the outer periphery of projection means facing rearwardly with respect to the proposed direction of ball flight, and a golf ball placed on the tee, a golf club swung at the tee and ball will strike the projection means and impart motion to the ball before the club makes direct contact with the surface of the ball.

15. A golf tee as claimed in claim 1 wherein the extension means is adapted to impart a backspin on the golf ball when the golf club strikes the extension means.

16. A golf tee as claimed in claim 2 wherein the golf tee is integrally molded as a single unit from a moldable plastic material.

* * * * *

UNITED STATES PATENT OFFICE

CERTIFICATE OF CORRECTION

Patent No. 3,947,027 Dated March 30, 1976

Inventor(s) DAVID F. BROWN

It is certified that error appears in the above-identified patent and that said Letters Patent are hereby corrected as shown below:

Column 3, line 11, after "7/8", --to--should be inserted.

Column 4, line 64, "obiviating" should be --obviating--.

Column 7, line 4, "fact" should be --face--.

Signed and Sealed this

Fifteenth Day of March 1977

[SEAL]

*Attest:*

RUTH C. MASON
*Attesting Officer*

C. MARSHALL DANN
*Commissioner of Patents and Trademarks*